US007753042B2

(12) United States Patent
Carnall et al.

(10) Patent No.: US 7,753,042 B2
(45) Date of Patent: Jul. 13, 2010

(54) MECHANISM FOR GAS OPERATED GUN

(75) Inventors: Martin Carnall, Barwell (GB); Paul Garry, Manchester (GB)

(73) Assignee: Blackmarket Sportz Limited, Nuneaton Warwickshire (GB)

( * ) Notice: Subject to any disclaimer, the term of this patent is extended or adjusted under 35 U.S.C. 154(b) by 0 days.

(21) Appl. No.: 11/347,555

(22) Filed: Feb. 3, 2006

(65) Prior Publication Data

US 2006/0169266 A1 Aug. 3, 2006

Related U.S. Application Data

(63) Continuation of application No. 10/870,687, filed on Jun. 17, 2004, now abandoned, which is a continuation-in-part of application No. 10/775,756, filed on Feb. 9, 2004, now Pat. No. 6,986,343.

(51) Int. Cl.
*F41B 11/00* (2006.01)

(52) U.S. Cl. ..... 124/31; 124/75; 124/77

(58) Field of Classification Search ..... 124/71–77; 127/31, 70–77
See application file for complete search history.

(56) References Cited

U.S. PATENT DOCUMENTS

| | | | | |
|---|---|---|---|---|
| 3,572,310 | A | 3/1971 | Chiba | 124/11 |
| 5,280,778 | A * | 1/1994 | Kotsiopoulos | 124/73 |
| 5,349,938 | A | 9/1994 | Farrell | 124/73 |
| 5,613,483 | A | 3/1997 | Lukas et al. | 124/73 |
| 5,769,066 | A | 6/1998 | Schneider | 124/75 |
| 6,644,295 | B2 * | 11/2003 | Jones | 124/77 |
| 6,810,871 | B2 * | 11/2004 | Jones | 124/77 |
| 2003/0005918 | A1 * | 1/2003 | Jones | 124/70 |
| 2003/0168052 | A1 * | 9/2003 | Masse | 124/73 |
| 2004/0084040 | A1 * | 5/2004 | Jones | 124/77 |
| 2004/0089280 | A1 * | 5/2004 | Kunimoto | 124/76 |
| 2004/0255923 | A1 * | 12/2004 | Carnall et al. | 124/73 |
| 2005/0005924 | A1 * | 1/2005 | Sheng | 124/74 |
| 2005/0028802 | A1 * | 2/2005 | Jones | 124/73 |
| 2005/0115550 | A1 * | 6/2005 | Jones | 124/65 |
| 2005/0115554 | A1 * | 6/2005 | Jones | 124/74 |
| 2006/0011188 | A1 * | 1/2006 | Jones | 124/77 |

* cited by examiner

*Primary Examiner*—Troy Chambers
(74) *Attorney, Agent, or Firm*—Caesar, Rivise, Bernstein, Cohen & Pokotilow, Ltd.

(57) ABSTRACT

The tubular bolt of a paintball gun communicates with a cylinder through bores when in a forward, firing position, allowing compressed gas from the cylinder to expel a paintball. In accordance with the invention a bore whereby the cylinder communicates with a source of compressed gas is occluded by the bolt when the bolt is in the firing position. By this arrangement only gas stored in the cylinder is used to fire a paintball and the source of compressed gas is not in communication with the cylinder except when the trigger is released and the bolt is in its retracted position.

7 Claims, 3 Drawing Sheets

MECHANISM FOR GAS OPERATED GUN

This application is a continuation of application Ser. No. 10/870,687 filed Jun. 17, 2004 now abandoned which was a continuation-in-part of application Ser. No. 10/775,756 filed Feb. 9, 2004 now U.S. Pat. No. 6,986,343. This application also claims priority from British applications 0327683.9 filed Nov. 28, 2003, 0404989.6 filed Mar. 5, 2004 and 0408954.6 filed Apr. 21, 2004.

FIELD OF THE INVENTION

This invention relates to an improved mechanism for a gas operated gun, by which is meant a gun of the type which fires a projectile by means of compressed gas. Guns of this kind are used in paintball games. Balls of paint are fired at other players to mark them.

BACKGROUND OF THE INVENTION

Conventional paintball guns have a hollow bolt which, when the trigger is pulled to file the gun, is moved from a rear to a forward position in the barrel, in the process selecting and moving forward the lowermost paintball in a magazine above the barrel. In the forward position of the bolt bores opening to its interior are exposed to compressed gas in a cylinder surrounding the bolt, causing the selected paintball to be expelled from the gun. When the trigger is released the bolt is moved back to its rear position, in which the bores are isolated from the cylinder.

A disadvantage of this otherwise simple arrangement is that more gas is used every time the gun is fired than is necessary to expel the selected paintball. Consequently the source of compress gas, usually an air cylinder fitted to the gun housing, has to be replaced quite frequently, which is an expense and inconvenience.

U.S. Pat. No. 5,613,483 seeks to address this problem by attaching a spool valve to the rear of the bolt. A fill and a dump chamber are positioned in the gun housing behind the bolt. In the rear position of the bolt both chambers are filled with compressed gas, but when the bolt moves forward the spool valve isolates the chambers so that only the gas stored in the dump chamber escapes through the hollow bolt to fire the selected paint ball. A drawback of this gun is its complexity and relatively high manufacturing and maintenance costs.

A principal object of the present invention is to provide a simpler solution to the problem addressed by U.S. Pat. No. 5,613,483 allowing conventional paintball guns to have the advantages of the gun of that Patent as a result of a simple modification.

SUMMARY OF THE INVENTION

In accordance with the present invention there is provided a mechanism for a gas operated gun having a housing and a trigger, the mechanism comprising a sleeve fixed relative to the housing, a hollow bolt slideable in the sleeve between a firing position when the trigger is pulled and a retracted position when the trigger is released and a cylinder in the sleeve surrounding the bolt, the bolt being adapted when in the retracted position to permit communication between the cylinder and a source of fluid under pressure while isolating the cylinder from the interior of the bolt and when in the firing position to isolate the cylinder from said source while communicating the cylinder with the interior of the bolt.

The bolt may be slideable on an air fill tube fixed relative to the housing, an O-ring seal being provided between the tube and the bolt, the tube having one or more radial opening rearward of said seal in communication with said source and the bolt having one or more radial opening which will move from one side to the other of said seal as the bolt moves between its firing and retracted positions, the arrangement being such that in the retracted position of the bolt the cylinder communicates with said source through the openings in the tube and bolt while the seal prevents communication between the cylinder and the interior of the bolt and such that in the firing position of the bolt the opening in the tube is occluded by the bolt and the opening in the bolt communicates the cylinder with the interior of the bolt.

Alternatively the sleeve may have a radial opening isolated from the cylinder in communication with said source and the bolt may have a circumferential recess positioned and dimensioned so that only when the bolt is in its retracted position the recess will communicate said port with the interior of the cylinder.

Said port may be located in the sleeve rearwardly of the cylinder and may communicate with said source via a passageway external to the cylinder and extending axially thereof.

In yet another embodiment of the invention a radial bore is provided in the sleeve isolated from the cylinder and in communication with said source, the outer periphery of the bolt having an axially elongated circumferential depression which in the retracted position of the bolt communicates said bore with the cylinder, the arrangement being such that in the firing position of the bolt said bore is occluded by the bolt while the cylinder is communicated with the interior of the bolt. The cylinder may have front and rear openings to the bolt, the front opening aligning with an opening of the bolt in the firing position of the latter and the rear opening aligning with said depression in the retracted position of the bolt.

Alternatively the cylinder may be open to the bolt throughout its length and said opening of the bolt may take the form of a circumferential array of holes in the bolt which will be exposed to the cylinder in the firing position of the bolt.

Means for displacing the bolt between its firing and retracted positions may surround the bolt in front of or behind said cylinder.

DETAILED DESCRIPTION OF PREFERRED EMBODIMENTS

Figure 1:
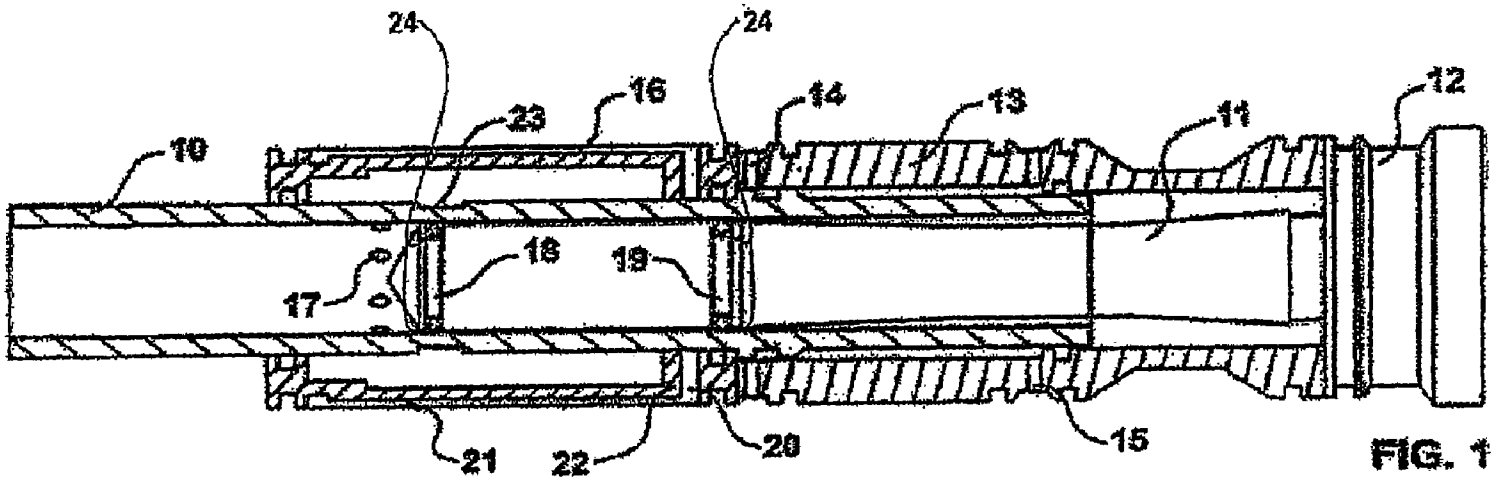
FIG. 1 illustrates part of the mechanism of a paintball gun according to a first embodiment of the invention showing the bolt in its forward or firing position.
Figure 2:
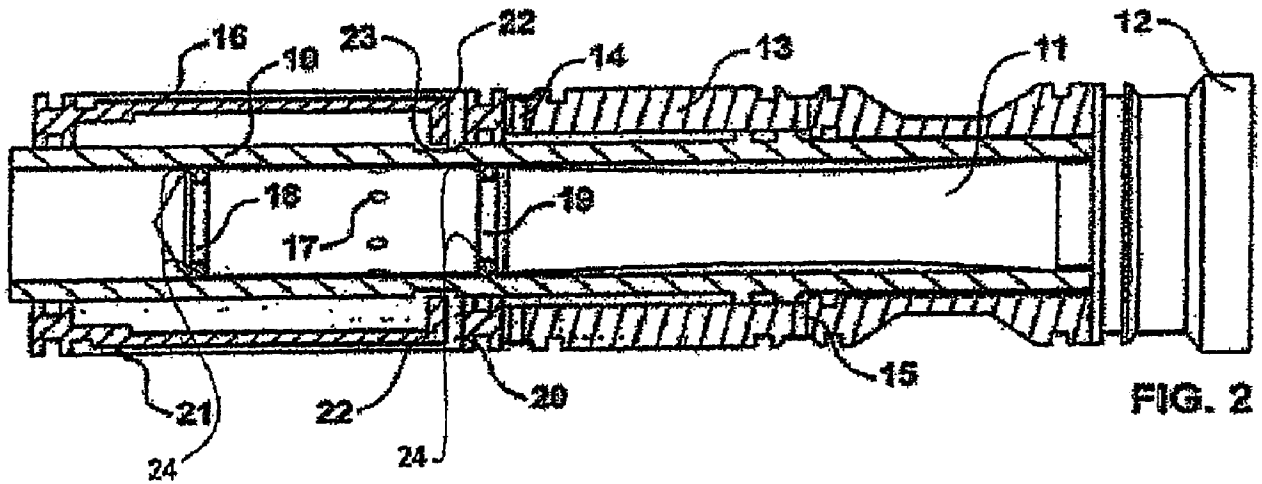
FIG. 2 illustrates the mechanism of FIG. 1 showing the bolt in its rear or withdrawn position.

Referring first to FIGS. 1 and 2, a paintball gun has a hollow, tubular bolt 10 which is slideable on a guide 11 fixed cantilever fashion to the rear of the gun housing (not shown) by its head 12. Surrounding the bolt and bolt guide is a mechanism 13 which serves to move the bolt 10 forward when the trigger (not shown) of the gun is pulled and rearward when the trigger is released. In the example illustrated this mechanism 13 works by placing a compressed gas canister (not shown) fitted to the gun selectively in communication with bores 14 and 15 whereby lands on the bolt will be driven in one direction or the other. This arrangement is conventional and so will not be further described, except to say that compressed gas actuation of the bolt may be replaced by an electronic system.

Forward of the mechanism 13 a cylinder 16 surrounds the bolt and bolt guide. The cylinder extends beyond the distal end of the bolt guide 11 so that in the forward position of the bolt (FIG. 1) an array of circumferentially spaced radial bores 17 of the bolt exposes the interior of the bolt to the interior of the cylinder 16. In the withdrawn position of the bolt (FIG. 2) however the bores 17 are between O-ring seals 24 in axially spaced circumferential grooves 18 and 19 of the bolt guide 11 and therefore occluded from the cylinder 16.

A port 20 at the rear of the cylinder 16 is in communication with the canister via a passageway 21 external to the cylinder and extending axially thereof. In accordance with a preferred embodiment of the invention the port 20 takes the form of a circumferential slot in a radial formation 22 at the rear of the cylinder dimensioned such that it is in contact with the periphery of the bolt 10 except when it is in register with a circumferential recess 23 in the bolt periphery. This occurs when the bolt 10 is in its withdrawn position (FIG. 2) and the recess 23 has a length axially of the bolt such that it permits communication of the port 20 with the interior of the cylinder 16. Therefore so long as the trigger of the gun is not pulled the cylinder 16 is charged with compressed gas which cannot escape to the interior of the bolt. When the trigger is pulled and the bolt 10 moves forward (FIG. 1) the charge of compressed gas can escape from the cylinder 16 through the bores 17 to the interior of the bolt 10, but meanwhile the port 20 is occluded by the periphery of the bolt because the recess 23 has moved forward. As is known per se the bolt 10 as it moves forward displaces in to the barrel of the gun the lowermost paintball in a magazine (not shown) mounted above the gun and the selected paintball is fired from the gun by the compressed gas escaping from the cylinder 16. When the trigger is released and the bolt 10 is moved back the cylinder 16 is isolated from the interior of the bolt and is recharged with compressed gas as soon as the recess 23 comes back into register with the port 20.

Figure 3:
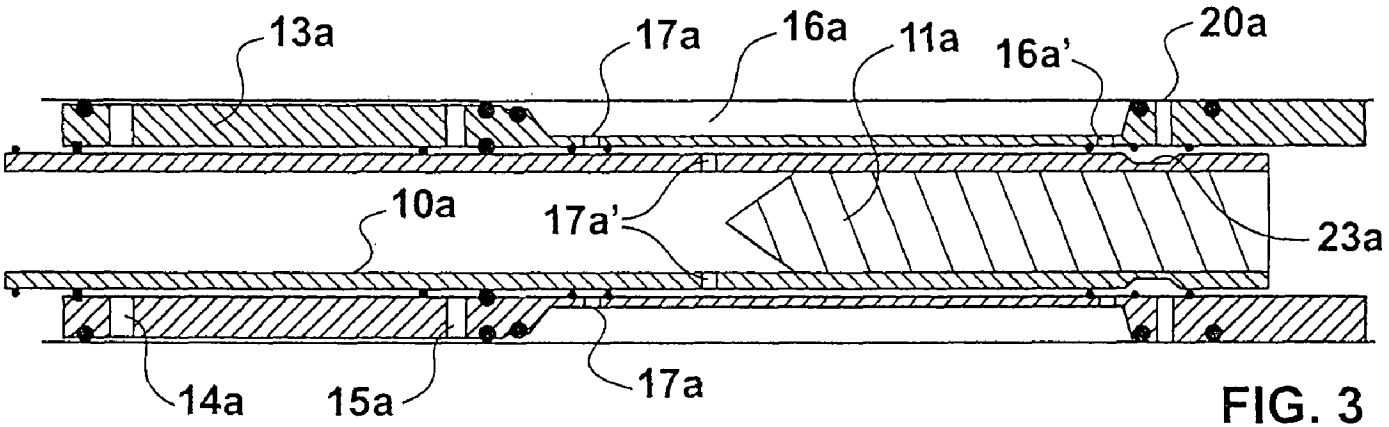
FIG. 3 illustrates part of the mechanism of a paintball gun according to a second embodiment of the invention showing the bolt in its rear or withdrawn position.
Figure 4:
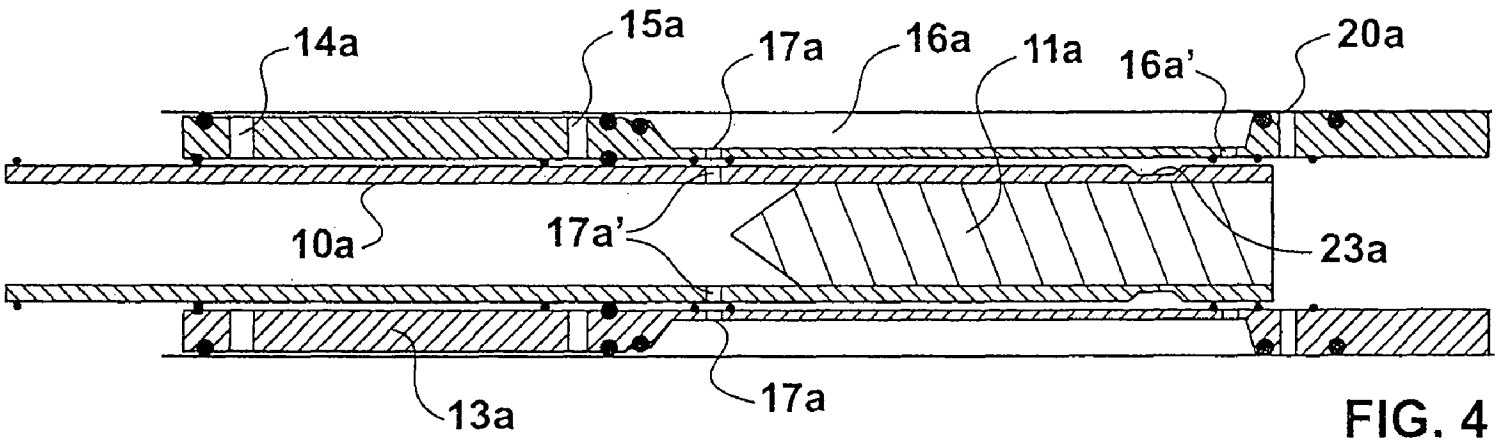
FIG. 4 illustrates the mechanism of FIG. 3 showing the bolt in its forward, firing position.

In the alternative embodiment of the invention illustrated in FIGS. 3 and 4 like parts have like references but with the suffix A. The arrangement is generally similar to that of FIGS. 1 and 2 except that the firing mechanism is positioned behind the bolt-moving mechanism and not in front of it.

A bolt 10A is slideable within a sleeve 13A between the positions shown in FIGS. 3 and 4. Bores 14A and 15A alternatively communicate with a canister of compressed air (not shown) to move the bolt 10A forward or back.

In a rearward part of the sleeve 13A is a chamber 16A in which compressed gas from the canister is stored when, in the rearward position of the bolt (FIG. 3) an axially elongated circumferential depression 23A in the periphery of the bolt communicates a bore 20A with an opening 16*a*' which opens from the chamber 16A to the inner periphery of the sleeve 13A.

When the bolt is moved forward to the position of FIG. 4 the chamber 16A is isolated from the bore 20A and an array of radial bores 17*a*' in the bolt comes into alignment with openings 17A of the chamber 16A to the inner periphery of the sleeve 13A. Thus compressed gas in the chamber 16A escapes to the interior of the bolt 10A to fire a paintball.

Figure 5:
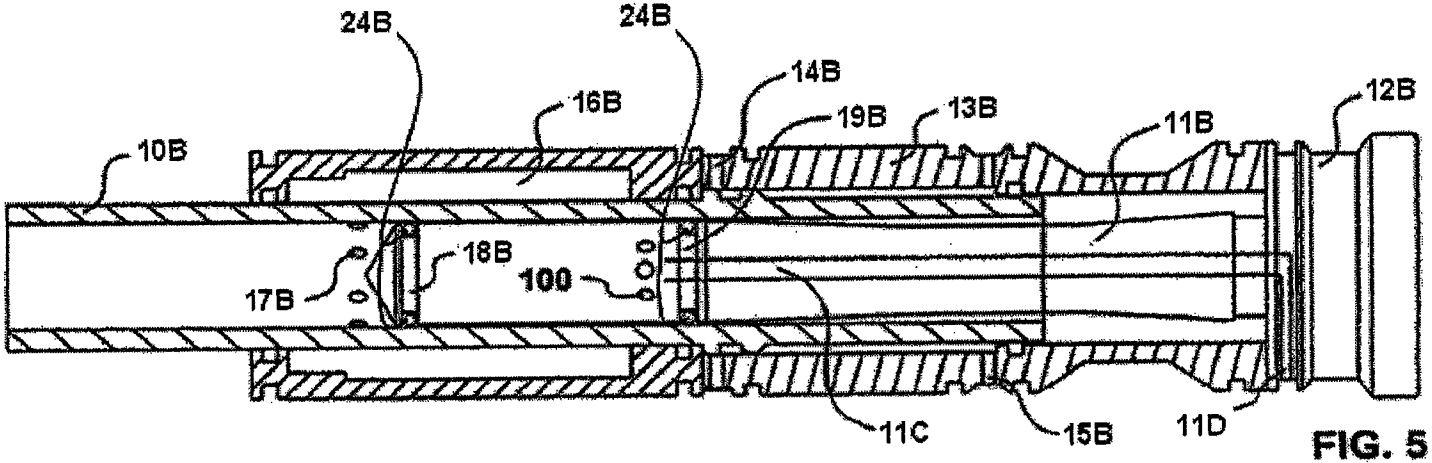
FIG. 5 illustrates part of the mechanism of a paintball gun according to a third embodiment of the invention showing the bolt in its forward or firing position.
Figure 6:
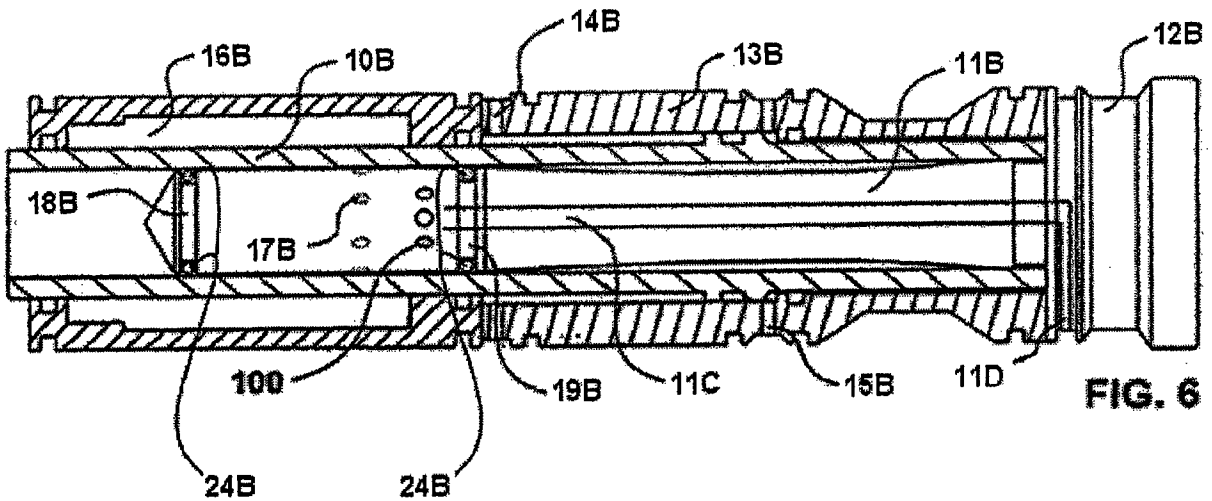
FIG. 6 illustrates the mechanism of FIG. 5 showing the bolt in its rear or withdrawn position.

A third embodiment of the invention is illustrated in FIGS. 5 and 6. The arrangement is similar to that of FIGS. 1 and 2 and like parts have like references but with the suffix B.

A bolt 10B is slideable within a sleeve 13B between the positions shown in FIGS. 5 and 6. Bores 14B and 15B alternatively communicate with a canister of compressed air (not shown) to move the bolt 10B forward or back.

The bolt 10B is slideable on a guide 11B similar to the guide 11 of the embodiment of FIGS. 1 and 2, but in this case the guide 11B selves as an air fill tube. It has a longitudinal bore 11C at the head 12B end communicating with the gas canister via a radial bore 11D and near to the other end of the guide 11B communicating with a circumferential array 100 of radial bores which open to the periphery of the guide 111B. It will be observed that the bores 100 open to the periphery of the guide 111B between the O-ring seals in their respective grooves 18B and 19B. In the firing position of the bolt 10B (FIG. 5), therefore, the bores 100 are occluded by the bolt and the cylinder 16B is isolated from the gas canister. However in the retracted position of the bolt 10B (FIG. 6) the bores 17B in the bolt have passed from a position in front of to a position behind the O-ring in groove 18B and are therefore in communication with the bores 100. Thus the cylinder 16B is placed in communication with the gas canister while at the same time it is isolated from the interior of the bolt 10B.

In a conventional paintball gun the equivalent of the cylinder 16, 16A or 16B is permanently in communication with the gas canister so that gas will escape through the bolt 10, 10A or 10B for as long as the latter remains in its forward, firing position. Such a gun can be readily modified in accordance with the present invention to ensure that when the gun is fired only compressed gas stored in the cylinder 16, 16A or 16B will escape.

What is claimed is:

1. A mechanism adapted for use in a gas-operated gun of the type having a housing, a trigger and a source of fluid under pressure fitted to the housing, the mechanism comprising a sleeve adapted to be fixed relative to the housing, a hollow bolt slideable in the sleeve between a retracted position and a firing position when the trigger is actuated, the hollow bolt comprising a wall having an inner surface defining a hollow interior thereof, the sleeve comprising a chamber surrounding the bolt, said wall having bores there through communicating the chamber with the hollow interior, the wall of the bolt when in the firing position having an outer surface segment that isolates the chamber from the source while permitting fluid communication between the chamber and the interior of the bolt through the bores and wherein the wall has a second segment that, when the bolt is in the retracted position permits fluid communication between the chamber and the source of fluid under pressure while the chamber is isolated from the interior of the bolt.

2. A mechanism as claimed in claim 1, wherein the second segment is a recess in the wall for permitting communication between the chamber and the source of fluid under pressure.

3. A mechanism as claimed in claim 1, wherein the bolt is slideable on an internal bolt guide, said internal bolt guide including axially spaced apart seals cooperating with the inner surface of the wall of the bolt with the bores through the wall being located axially between the seals when the bolt is in a retracted position to isolate the chamber from the interior of the bolt.

4. A mechanism as claimed in claim 1, wherein the sleeve has a radial opening being isolated from the chamber by said outer surface segment and being in communication with said source when said bolt is in the firing position and the second segment being a circumferential recess positioned and dimensioned so that the recess communicates said opening with the interior of the chamber only when the bolt is in its retracted position.

5. A mechanism as claimed in claim 4, wherein said opening is located in the sleeve rearwardly of the chamber and communicates with said source via a passageway external to the chamber and extending axially thereof.

6. A mechanism as claimed in claim 1, wherein the mechanism comprises a radial aperture in the sleeve isolated from the chamber and in communication with said source, the second segment being an axially elongated circumferential recess, which in the retracted position of the bolt communicates said aperture with the chamber, the arrangement being such that in the firing position of the bolt said aperture is occluded by the outer surface segment of the bolt while the chamber is communicated with the interior of the bolt through the bores.

7. A mechanism as claimed in claim 1, wherein the chamber is open to the bolt throughout its length and wherein said bores are a circumferential array of apertures through the wall of the hollow bolt, said circumferential array of apertures being exposed to the chamber in the firing position of the bolt.

* * * * *

UNITED STATES PATENT AND TRADEMARK OFFICE

CERTIFICATE OF CORRECTION

PATENT NO. : 7,753,042 B2
APPLICATION NO. : 11/347555
DATED : July 13, 2010
INVENTOR(S) : Martin Carnall et al.

It is certified that error appears in the above-identified patent and that said Letters Patent is hereby corrected as shown below:

Title Page item 73

Assignee: ~~Blackmarket~~ Sportz Limited, Nuneaton
Warwickshire (GB)

CORRECTED NAME OF ASSIGNEE:

Assignee: Black Market Sportz Limited, Nuneaton
Warwickshire (GB)

Signed and Sealed this

Twenty-eighth Day of September, 2010

David J. Kappos

David J. Kappos
*Director of the United States Patent and Trademark Office*